US006867555B2

(12) United States Patent
Gyoten

(10) Patent No.: US 6,867,555 B2
(45) Date of Patent: Mar. 15, 2005

(54) INTENSITY MODULATOR FOR LIGHT SOURCE SUCH AS AC LAMP

(75) Inventor: Takaaki Gyoten, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/677,267

(22) Filed: Oct. 3, 2003

(65) Prior Publication Data

US 2004/0080284 A1 Apr. 29, 2004

(30) Foreign Application Priority Data

Oct. 8, 2002 (JP) ..... P2002-294486

(51) Int. Cl.[7] ..... G05F 1/00

(52) U.S. Cl. ..... 315/291; 315/248; 315/307; 315/DIG. 4

(58) Field of Search ..... 315/248, 291, 315/307, 199, DIG. 4; 348/500, 521, 525, 533, 547; 349/33, 37

(56) References Cited

U.S. PATENT DOCUMENTS 3,719,857 A * 3/1973 Sharp ..... 315/156
4,263,615 A * 4/1981 Steinmetz et al. ..... 348/540
6,433,492 B1 * 8/2002 Buonavita ..... 315/248

FOREIGN PATENT DOCUMENTS

JP 5-219462 8/1993

* cited by examiner

*Primary Examiner*—Haissa Philogene
(74) *Attorney, Agent, or Firm*—McDermott Will & Emery LLP

(57) ABSTRACT

At the time of light passage control for light output by driving a light source by means of a light source driving circuit for generating an output fluctuation point on a time axis periodically, a modulation controller sets predetermined synchronizing periods and a plurality of unit periods with different time lengths at each of the synchronizing periods, and controls light passage using a light passage controller at each of the unit periods. The modulation controller selects a unit period, where the intensity error which occurs with the output fluctuation point being inserted is predicted not to be visually recognized with human's eyesight characteristics, from the unit periods, and controls arrangement of the unit periods so that the output fluctuation point is inserted into the selected unit period. As a result, flicker due to the error of modulated output light is hardly visually recognized by a viewer without reducing the intensity of modulated output light.

9 Claims, 16 Drawing Sheets

FIG. 3 *(PRIOR ART)*

INTENSITY MODULATOR FOR LIGHT SOURCE SUCH AS AC LAMP

FIELD OF THE INVENTION

The present invention relates to an intensity modulator for outputting output light from a light source such as an AC lamp by modulating the output light into an ON/OFF state using a light passage controller such as a fast-response liquid crystal display.

BACKGROUND OF THE INVENTION

In intensity modulators for modulating intensity of an AC lamp based on pulse width modulating control, a light switching element is arranged in front of the AC lamp. Output light from the AC lamp enters the light switching element arranged in front of it, and its intensity is modulated by the light switching element. In this case, a driving current of the AC lamp synchronizes with a vertical synchronizing signal so that its polarity is inverted, and the driving current becomes zero at the inverting timing. The intensity of the output light from the AC lamp fluctuates with respect to the zero point of the driving current, and intensity error or flicker occurs in the light whose intensity is modulated by the light switching element. In the prior examples, therefore, during a period where the output light from the AC lamp fluctuates, the light switching element is controlled to be off so that the fluctuation of the output light is suppressed, but such suppression reduces the intensity of the output light according to a period where the light switching element is controlled to be off.

SUMMARY OF THE INVENTION

According to the present invention, an intensity modulator includes: a light source driving circuit for periodically generating an output fluctuation point on a time axis; a light source which is driven by the light source driving circuit so as to output light; a light passage controller for controlling passage of the light; and a modulation controller for setting predetermined synchronizing periods and a plurality of unit periods with different time lengths in each of the synchronizing periods, controlling passage of the light using the light passage controller at each of the unit periods, and controlling intensity of the light so as to modulate pulse width at each of the synchronizing periods. The intensity modulator has a following constitution.

The modulation controller displays a function for selecting the unit period, where the intensity error which occurs with the output fluctuation point being inserted is predicted not to be visually recognized with human's eyesight characteristics, from the unit periods, and controlling arrangement of the unit periods so that the output fluctuation point is inserted into the selected unit period.

As a result, flicker due to the intensity error which occurs in the light which undergoes the modulating process is hardly visually recognized by a viewer. It is preferable that an occurrence cycle of the output fluctuation point synchronizes with the synchronizing period. As a result, the control for inserting the output fluctuation point into the predetermined synchronizing period becomes easy, and accuracy of the control is improved. It is preferable that the modulation controller selects the unit period where the intensity error is predicted so as not to be visually recognized from the unit periods for a level of intensity generated by making the passage control of the light using the light passage controller based on a ratio (intensity error/intensity level) of the intensity error occurring by inserting the output fluctuation point into the unit periods. As a result, the unit period is selected easily and the accuracy of the control is improved. One example of the unit period to be selected is a unit period with the longest time length. When a level of the intensity error is comparatively low, the similar effect is obtained even if a unit period other than the unit period with the longest length is selected.

It is preferable that the time length of the unit period, into which the output fluctuation point is inserted, is adjusted into a length with which the intensity error can be corrected. As a result, the intensity error is reduced, and thus the flicker due to the intensity error is substantially not visually recognized by the viewer. One example of the light source driving circuit is a circuit which is configured by an AC power source for switching its polarity alternatively. In this case, the output fluctuation point is generated when the polarity of the AC power source is switched. Another example of the light source driving circuit is a circuit which is configured by an AC power source for switching its polarity alternatively with a cycle of multiplying the synchronizing period. In this case, since the occurrence cycle of the intensity error becomes short, the flicker due to the intensity error is substantially not visually recognized by the viewer. Another example of the light source driving circuit is a circuit configured by a DC power source for generating an electric current at each synchronizing period. Also in this case, the present invention displays the similar effect.

BRIEF DESCRIPTION OF THE DRAWINGS

The other objects of the invention will become apparent from the following preferred embodiments explained below and attached claims. Numerous advantages which are not mentioned in this specification will become clear for those skilled in the art after carrying out the invention.

DETAILED DESCRIPTION OF THE INVENTION

Preferred embodiments of the present invention are explained below with reference to the drawings.

(First Embodiment)

Figure 1:
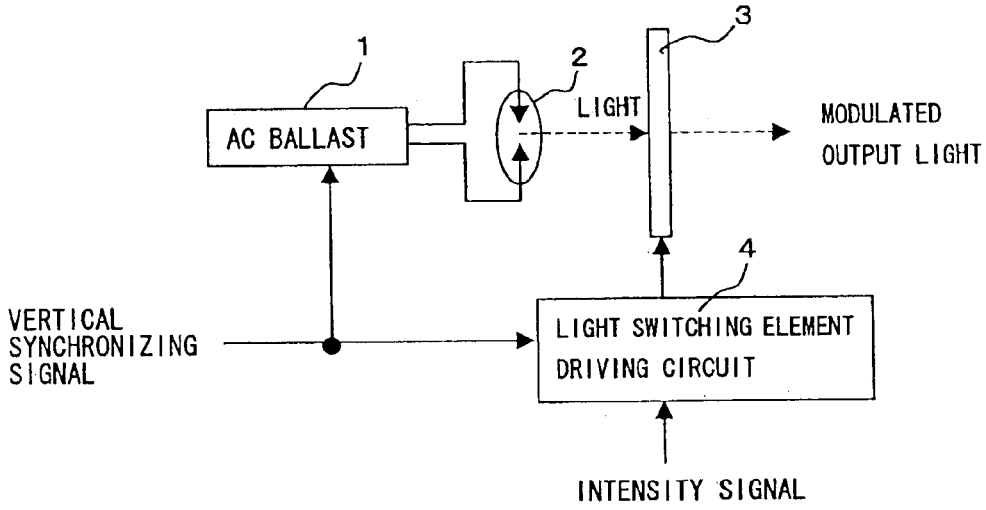
FIG. 1 is a diagram illustrating a constitution of an intensity modulator according to a first preferable embodiment of the present invention.
Figure 4:
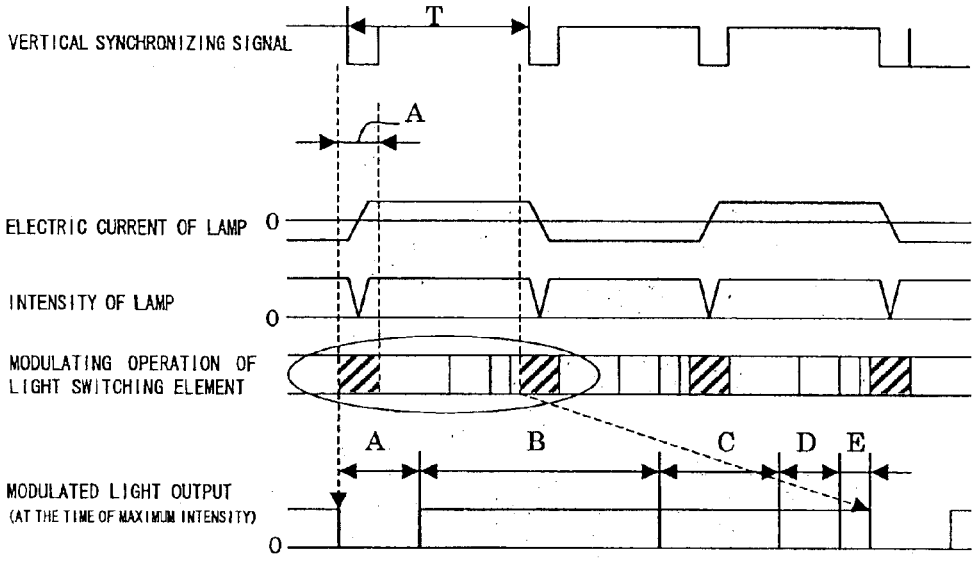
FIG. 4 is a timing chart explaining a general operation of an intensity modulating circuit.
Figure 5:
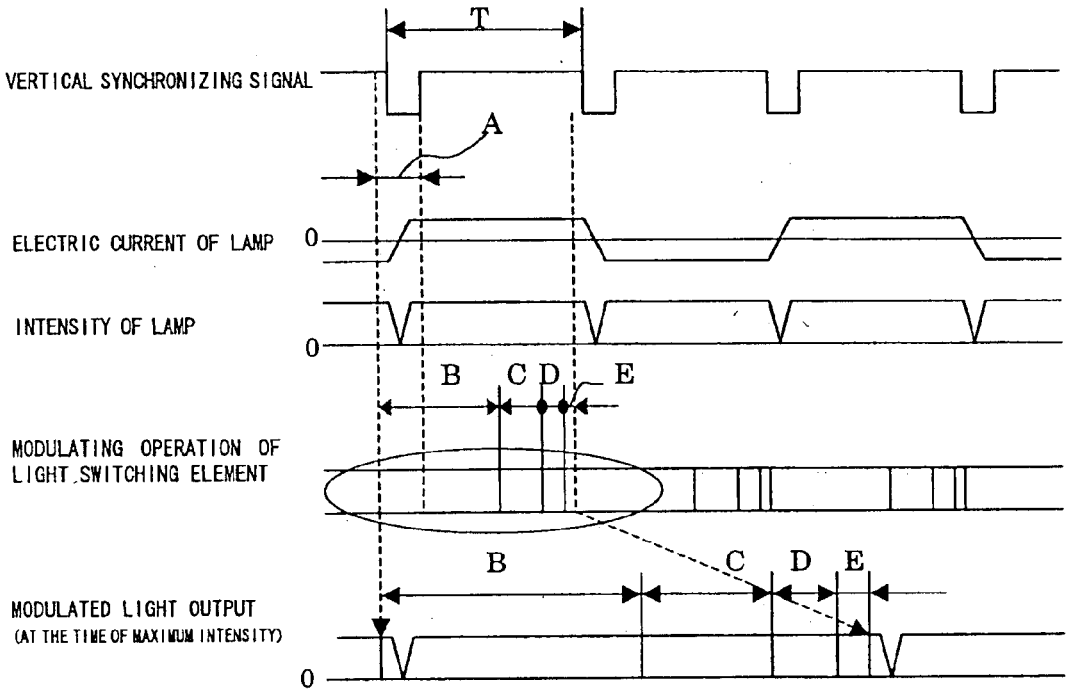
FIG. 5 is a timing chart explaining an operation of the intensity modulator according to the first embodiment.

With reference to FIGS. 1, 4 and 5, an intensity modulator of this embodiment is explained. An AC ballast 1 outputs an AC output whose polarity is inverted alternatively at each synchronizing period T in a state that a current value of the AC output is stable. An AC lamp 2 is driven by the AC ballast 1. A light switching element 3 is arranged on an output axis of output light from the AC lamp 2 and controls passage of the output light from the AC lamp 2. A light switching element driving circuit 4 operates as follows. The light switching element driving circuit 4 sets a plurality of unit periods (B, C, D and E) with different time lengths in each period T defined by a vertical synchronizing signal, and allows the light switching element 3 to control the passage of the light at each of the unit periods (B, C, D, and E). As a result, the light switching element driving circuit 4 controls intensity of the light output from the light switching element 3 so as to modulate a pulse width at each period T.

In this embodiment, one example of a light source driving circuit is constituted by the AC ballast 1. One example of a light source is constituted by the AC lamp 2. One example of a light passage controller is constituted by the light switching element 3. One example of a modulation controller is constituted by the light switching element driving circuit 4.

Figure 2:
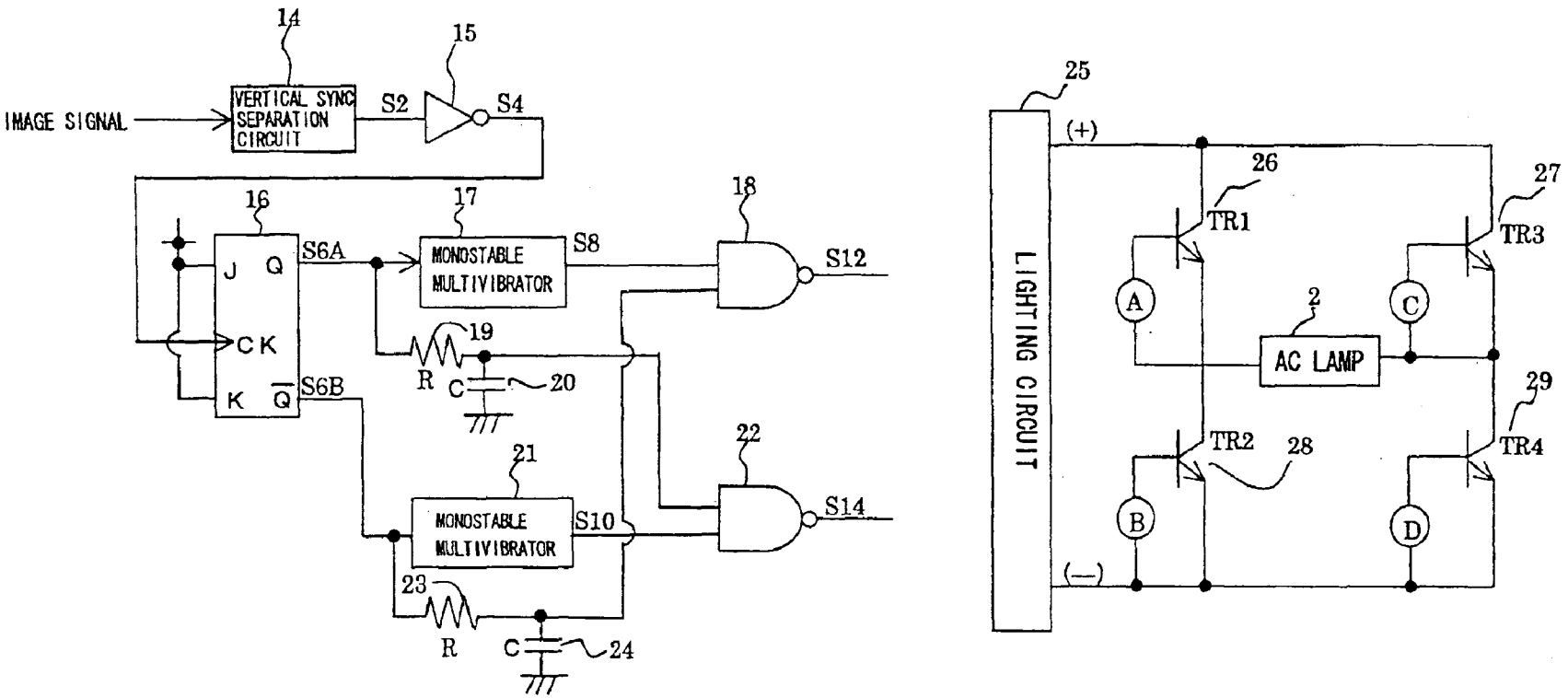
FIG. 2 (PRIOR ART)
FIG. 2 is a circuit diagram illustrating an AC ballast which can be incorporated into the intensity modulator of the present invention.

A general-purpose AC ballast can be used in the present invention. In this embodiment, the AC ballast 1 shown in FIG. 2 which is conventionally known is used, but one having another constitution can be used. The AC ballast 1 has a vertical sync separation circuit 14, an inverter 15, a JK flip-flop 16, monostable multivibrators 17 and 21, NAND gates 18 and 22, resistors 19 and 23, capacitors 20 and 24, a lighting circuit 25, and transistors 26 to 29.

Figure 3:
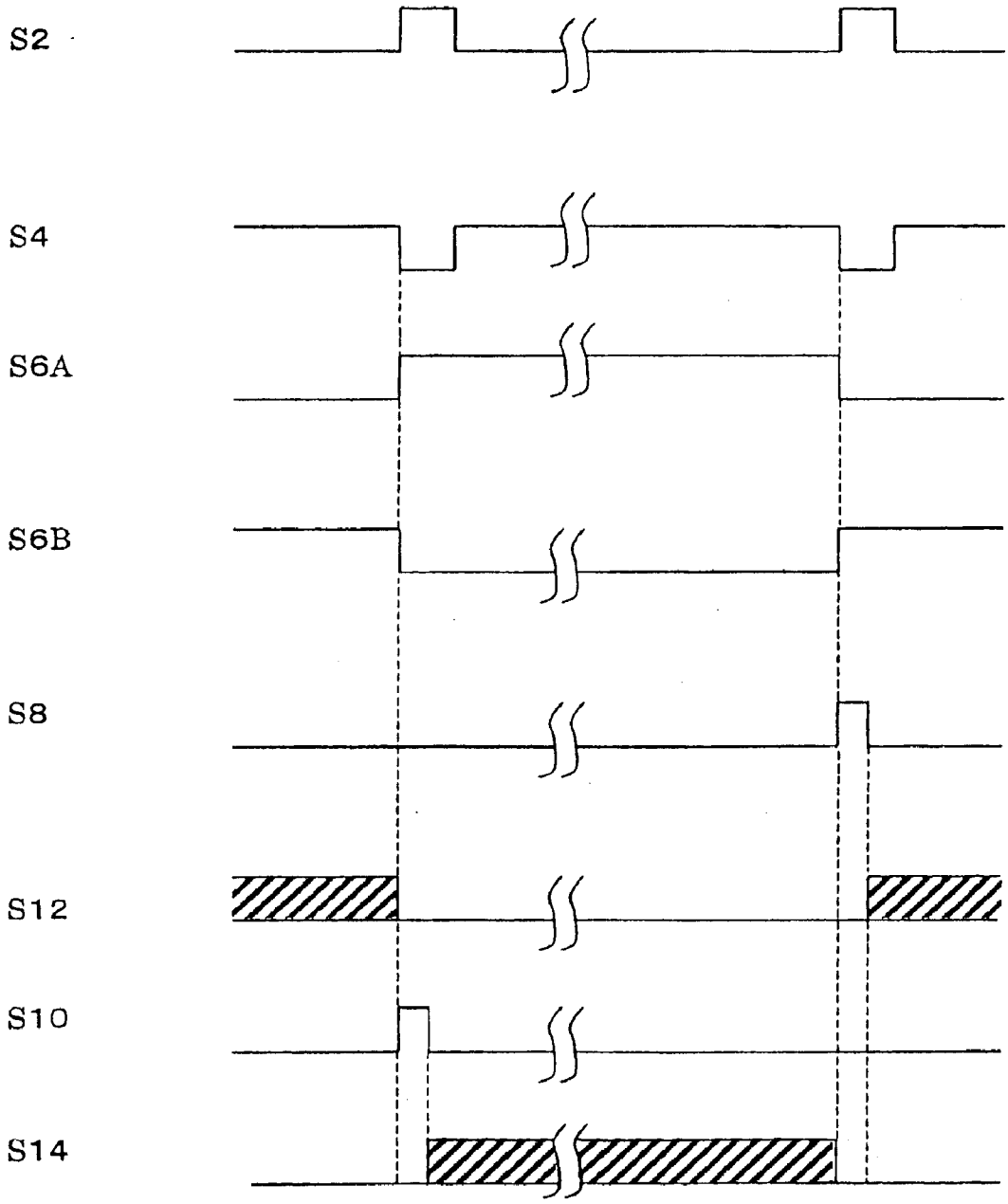
FIG. 3 is a timing chart explaining an operation of the AC ballast.

FIG. 3 illustrates a timing chart of an operation of the AC ballast 1. The AC ballast 1 separates a vertical synchronizing signal from an image signal input into the vertical sync separation circuit 14. The vertical synchronizing signal to be separated is represented by S2 in FIGS. 2 and 3. Polarity of the vertical synchronizing signal S2 is inverted by the inverter 15. The vertical synchronizing signal to be inverted is represented by S4 in FIGS. 2 and 3. An output from the inverter 15 is input into a clock input of the JK flip-flop 16. The JK flip-flop 16 generates signals S6A and S6B based on the output from the inverter 15. The signals S6A and S6B are inverted at each vertical synchronizing signal.

The signal S6A is input into the monostable multivibrator 17 and the resistor 49. The monostable multivibrator 17 outputs a pulse at the timing of a trailing edge of the signal S6A. This pulse is represented by S8 in FIGS. 2 and 3. The pulse S8 is input into one input terminal of the NAND gate 18.

The signal S6A to be input into the resistor 19 passes through a filter (19+20) composed of the resistor 19 and the capacitor 20 and is input into the other input terminal of the NAND gate 22. Since a time constant of the filter (19+20) is set so as to be very shorter than a repeating cycle of the signal S6A, the signal S6A is input into the NAND gate 22 in a state that its waveform does not change.

The signal S6B is input into the monostable multivibrator 21 and the resistor 23. The monostable multivibrator 21 outputs a pulse at the timing of a trailing edge of the signal S6B. This pulse is represented by S10 in FIGS. 2 and 3. The pulse S10 is input into one input terminal of the NAND gate 22.

The signal S6B to be input into the resistor 23 passes thorough a filter (23+24) composed of the resistor 23 and the capacitor 24, and is input into the other input terminal of the NAND gate 18. Since a time constant of the filter (23+24) is set so as to be substantially shorter than a repeating cycle of the signal S6B, the signal S6B is input into the NAND gate 18 in a state that its waveform is not changed.

Outputs S12 and S14 from the NAND gates 18 and 22, as shown in FIG. 3, starts at the time delayed by a constant time from a leading edge of the vertical synchronizing signal S2 and ends at a leading edge of a next vertical synchronizing signal S2.

The output S12 from the NAND gate 18 drives the transistors 26 and 29. The output S14 from the NAND gate 22 drives the transistors 27 and 28. The AC lamp 2 is connected with the lighting circuit 25 in a state that its polarity is inverted alternatively by a switching function of the transistors 26 to 29. The polarity inverting cycle is a cycle of the vertical synchronizing signal. The direction of an electric current flowing in the AC lamp 2 changes alternatively upon a polarity inverting operation.

In such a manner, the AC ballast 1 periodically inverts the direction of the electric current to be supplied to the AC lamp 2 in a state that an absolute value of a current value is approximately constant. As a result, as shown in FIG. 4, an output intensity level of the AC lamp 2 becomes approximately constant.

Pulse width modulation control of the intensity level which is made by the light switching element 3 and the light switching element driving circuit 4 is explained below. The outline of the unit periods B, C, D and E shown in FIG. 4 is explained above, but in more detail, each of the unit periods is a period which becomes one unit where the light switching element 3 controls ON/OFF of the output light from the AC lamp 2 in the pulse width modulation control. A total period, which is obtained by summing up time intervals of the unit periods B, C, D and E, is set according to a period T (for example, 1/60sec.) defined by the vertical synchronizing signal. The total period is preferably set so as to match the period T, but it may be set so as to be slightly shorter than the period T as long as the total period synchronizes with the period T.

When the light switching element 3 controls ON/OFF of the output light from the AC lamp 2, the light switching element driving circuit 4 controls the intensity level of the output light from the AC lamp 2 so as to modulate the pulse width in the following manner.

The time length of the period T defined by the vertical synchronizing signal is divided into the unit periods A, B, C, D and E. A determination is made whether ON control is made at each of the divided unit periods A, B, C, D and E. When the determination is made whether the ON control is made, a total time length of the unit periods A, B, C, D and E for the ON control is set according to the intensity level to be input. As a result, the intensity is modulated according to the level of the intensity signal to be input by the pulse width modulation control.

In the example shown in FIG. 4, the unit periods B, C, D and E are set as follows. When a time length of the unit period E is a basic time length, the unit period D is set to a time length which is twice as long as the unit period E. The unit period C is set to a time length which is twice as long as the unit period D. The unit period B is set to a time length which is twice as long as the unit period C. The total time length (B+C+D+E), which is obtained by summing up the time lengths of the unit periods B, C, D and E, becomes approximately equal to or slightly shorter than the period T defined by the cycle of the vertical synchronizing signal.

In the pulse width modulation control, an open/close operation of the light switching element 3 at the unit periods B, C, D and E is controlled within 16 stages as follows.

When the intensity signal level at the period T is set to 0, the open/close operation is OFF at all the unit periods of this period T, so that a relative intensity level at the period T becomes 0.

When the intensity signal level at the period T is set to 1, the open/close operation is ON at the unit period E of the period T, so that the relative intensity level at the period T becomes 1.

When the intensity signal level at the period T is set to 2, the open/close operation is ON at the unit period D of the period T, so that the relative intensity level at the period T becomes 2.

When the intensity signal level at the period T is set to 3, the open/close operation is ON at the unit periods D and E of the period T, so that the relative intensity level at the period T becomes 3.

When the intensity signal level at the period T is set to 4, the open/close operation is ON at the unit period C of the period T, so that the relative intensity level at the period T becomes 4.

When the intensity signal level at the period T is set to 5, the open/close operation is ON at the unit periods C and E of the period T, so that the relative intensity level at the period T becomes 5.

When the intensity signal level at the period T is set to 6, the open/close operation is ON at the unit periods C and D of the period T, so that the relative intensity level at the period T becomes 6.

When the intensity signal level at the period T is set to 7, the open/close operation is ON at the unit periods C, D and E of the period T, so that the relative intensity level at the period T becomes 7.

When the intensity signal level at the period T is set to 8, the open/close operation is ON at the unit period B of the period T, so that the relative intensity level at the period T becomes 8.

When the intensity signal level at the period T is set to 9, the open/close operation is ON at the unit periods B and E of the period T, so that the relative intensity level at the period T becomes 9.

When the intensity signal level at the period T is set to 10, the open/close operation is ON at the unit periods B and D of the period T, so that the relative intensity level at the period T becomes 10.

When the intensity signal level at the period T is set to 11, the open/close operation is ON at the unit periods B, D and E of the period T, so that the relative intensity level at the period T becomes 11.

When the intensity signal level at the period T is set to 12, the open/close operation is ON at the unit periods B and C of the period T, so that the relative intensity level at the period T becomes 12.

When the intensity signal level at the period T is set to 13, the open/close operation is ON at the unit periods B, C and E of the period T, so that the relative intensity level at the period T becomes 13.

When the intensity signal level at the period T is set to 14, the open/close operation is ON at the unit periods B, C and D of the period T, so that the relative intensity level at the period T becomes 14.

When the intensity signal level at the period T is set to 15, the open/close operation is ON at the unit periods B, C, D and E of the period T, so that the relative intensity level at the period T becomes 15.

In the pulse width modulation control, modulated light according to the intensity signal is generated as mentioned above. The light switching element driving circuit 4 made the modulation control on the light switching element 3. The modulated output light is, as shown in FIG. 5, obtained by multiplying the output intensity of the AC lamp 2 and a modulation operation of the light switching element 3 together.

FIGS. 4 and 5 shows examples in the case where the intensity signal is 4 bits. When an intensity signal, in which a number of bits is more, is adopted, a unit of the time where the light switching element 3 is turned on/off is divided into more units.

The electric current supplied from the AC ballast 1 to the AC lamp 2 , as shown in FIG. 4, synchronizes with the vertical synchronizing signal and is controlled so that its polarity is inverted. An output of the electric current supplied to the AC lamp 2 becomes zero at the timing that the polarity is switched. For this reason, the intensity of the AC lamp 2 is reduced at the period in a vicinity of the zero point of the electric current output. This period is called as an output fluctuation point A. The output fluctuation point A is represented by slanted lines in FIG. 4. The output fluctuation point A is an intensity unmatching period where a proportional relationship is not established between a time length of the unit period where the light switching element 3 is turned on and the actual intensity of the light output. When the intensity is modulated without considering the output fluctuation point A which is the intensity unmatching period, this causes intensity error in the modulated output light.

In the invention, the following control method is adopted, so that the modulated output light is modulated accurately according to the intensity signal without reducing the intensity of the modulated output light.

The light switching element driving circuit 4 of this embodiment, as shown in FIG. 5, controls the light switching element 3 so that the output fluctuation point A is inserted into a unit period where the light switching element 3 is turned on/off by a most significant bit of the intensity modulation (hereinafter, called the most significant bit period). In this embodiment, the light switching element driving circuit 4 controls the light switching element 3 so that the output fluctuation point A synchronizes with the cycle of the vertical synchronizing signal, and output timing of the output fluctuation point A matches with pulse output timing of the vertical synchronizing signal. More specifically, the light switching element driving circuit 4 controls the light switching element 3 so that the most significant bit period is overlapped with the pulse output timing of the vertical synchronizing signal. Still more specifically, the light switching element driving circuit 4 controls the light switching element 3 so that all the periods where the lamp supply electric current becomes unstable before and after the output fluctuation point A are included in the most significant bit period. In the example of FIG. 4, the most significant bit period corresponds to the unit period B.

With such setting, intensity error appears in the modulated output light at the setting of the intensity such that the most significant bit period is ON, but intensity error does not appear in the modulated output light at the setting of the intensity such that the most significant bit period is OFF. The most significant bit period is ON when the intensity level to be set is 50% or more of its maximum value. When the 16-stage intensity level is set, the 50% of the intensity level is the 8-stage intensity level.

Figure 6:
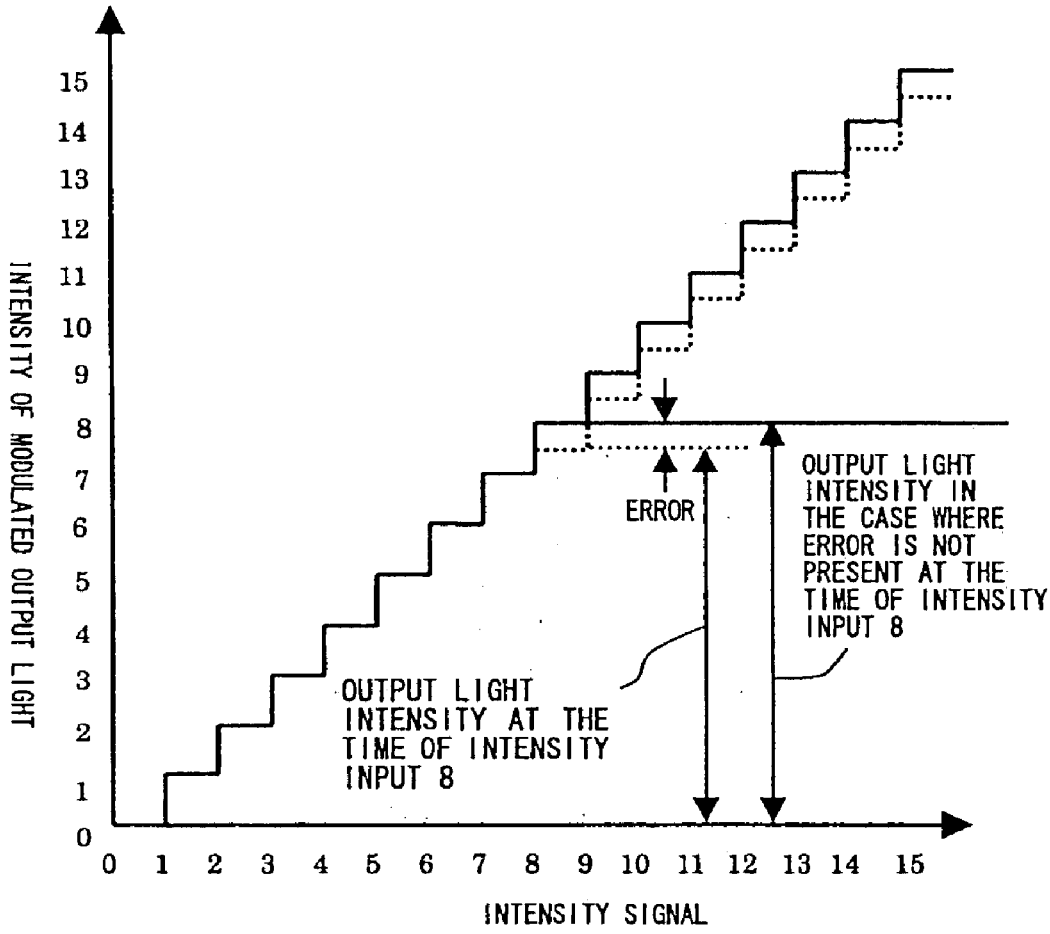
FIG. 6 is a diagram illustrating a relationship between an intensity signal and intensity of modulated output light in the intensity modulator according to the first embodiment.

When the output condition of intensity error is set as mentioned above, flicker due to the intensity error is essentially not visually recognized by a viewer. The following explains the reason why. FIG. 6 shows a relationship between each stage of the intensity signal and the intensity of the modulated output light. A solid line in the drawing represents an ideal relationship between them, and a dotted line in the drawing represents a relationship between them in the intensity modulator of the embodiment.

As mentioned above, the intensity modulator of this embodiment makes the control operation so that intensity error occurs selectively in the modulated output light in the case where the intensity level to be set is 50% or more of its maximum value. In this case, when the intensity level to be set becomes 50% or more of the maximum intensity of the intensity signal (at the 16-stage intensity levels, 8 or more stages), the intensity level of the modulated output light displaces from the ideal intensity level. Concretely, the intensity level of the modulated output light is reduced from the ideal intensity level.

It is known that resolution with which human's eyes can discriminate intensity error depends on a ratio of the intensity error to the output intensity level. This ratio is calculated according to (intensity error/output intensity level). Hereinafter, the ratio is referred to as an error ratio.

People have eyesight characteristics such that intensity error cannot be visually recognized if the error ratio does not become large to a certain extent or more. The present invention pays attention to such eyesight characteristics, so that the output fluctuation point A is arranged. Specifically, in the present invention the output fluctuation point A is inserted into the unit period where the output intensity level, at which the intensity error is essentially not visually recognized due to the eyesight characteristics because the error ratio calculated based on the occurring intensity error is small, is generated. The unit period here is, as mentioned above, a period which is a time unit that the light switching element 3 controls ON/OFF states of the output light from the AC lamp 2.

As a result, flicker due to the intensity error caused by switching of the polarity of the electric current is essentially not visually recognized by the viewer.

At the unit period into which the output fluctuation point A is inserted, as the output intensity level is higher, the error ratio becomes smaller, so that the flicker due to the intensity error is difficult to visually recognize. In this embodiment, therefore, as the unit period into which the output fluctuation point A is inserted, the most significant bit period (unit period B) is selected. The unit period into which the output fluctuation point A is inserted may be, however, another unit period (for example, unit period C) as long as it is a unit period where the error ratio is such that the flicker due to the intensity error is essentially not visually recognized. For example, when the occurring intensity error is comparatively small, even if the output fluctuation point A is arranged in the unit period (for example, unit period C) other than the most significant bit period, the flicker due to the intensity error cannot be visually inspected by the viewer. In this case, the light switching element driving circuit 4 controls the light switching element 3 so that the output fluctuation point A is inserted into the unit period (unit period C or the like) other than the most significant bit period.

When the above-mentioned control method is used, the viewer hardly visually recognizes the flicker due to the intensity error occurring in the modulated intensity output.

In general, as high-intensity ultra-high pressure mercury AC lamps include a lamp in which an electric current is increased intentionally at the timing of switching polarity and flicker properties are improved. When the AC lamp having such a constitution is used, the intensity error occurs, and the occurring intensity error becomes higher than an ideal value. The intensity modulator of the present invention displays an effect in the intensity modulator having such an AC lamp.

(Second Embodiment)

Figure 7:
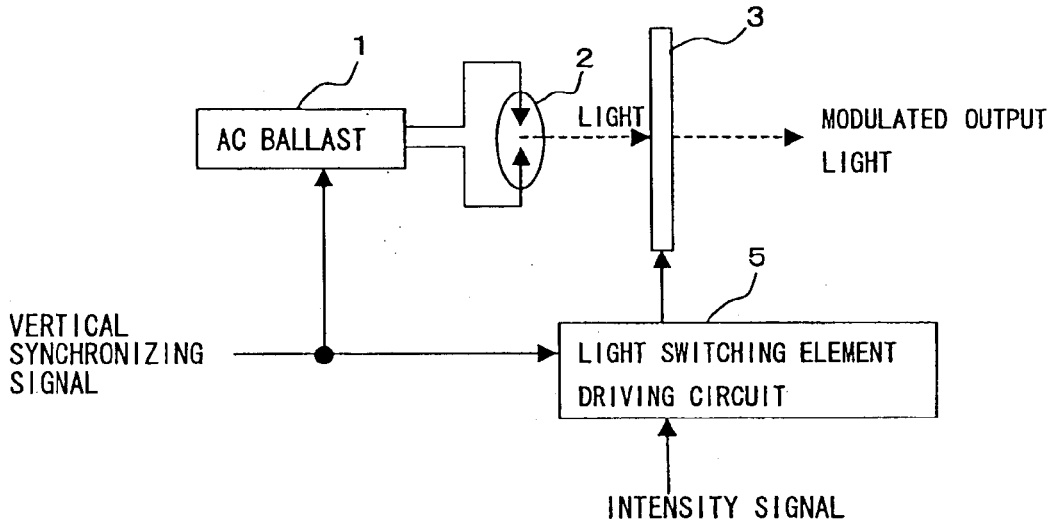
FIG. 7 is a diagram illustrating a constitution of the intensity modulator according to a second embodiment of the present invention.

FIG. 7 illustrates a constitution of the intensity modulator of a second embodiment. The intensity modulator of the second embodiment basically has a constitution similar to the first embodiment. For this reason, in FIG. 7, like parts are designated by like reference numerals of FIG. 1. The second embodiment is characterized by a control operation performed by the light switching element driving circuit 5. The following assumes and explains the case where the control, for inserting the output fluctuation point A into the unit period B which is the most significant bit period, is made similarly to the first embodiment. In the second embodiment, however, the same operation is performed even in the case where the control, for inserting the output fluctuation point A into another unit period (unit period C or the like), is made.

Figure 8:
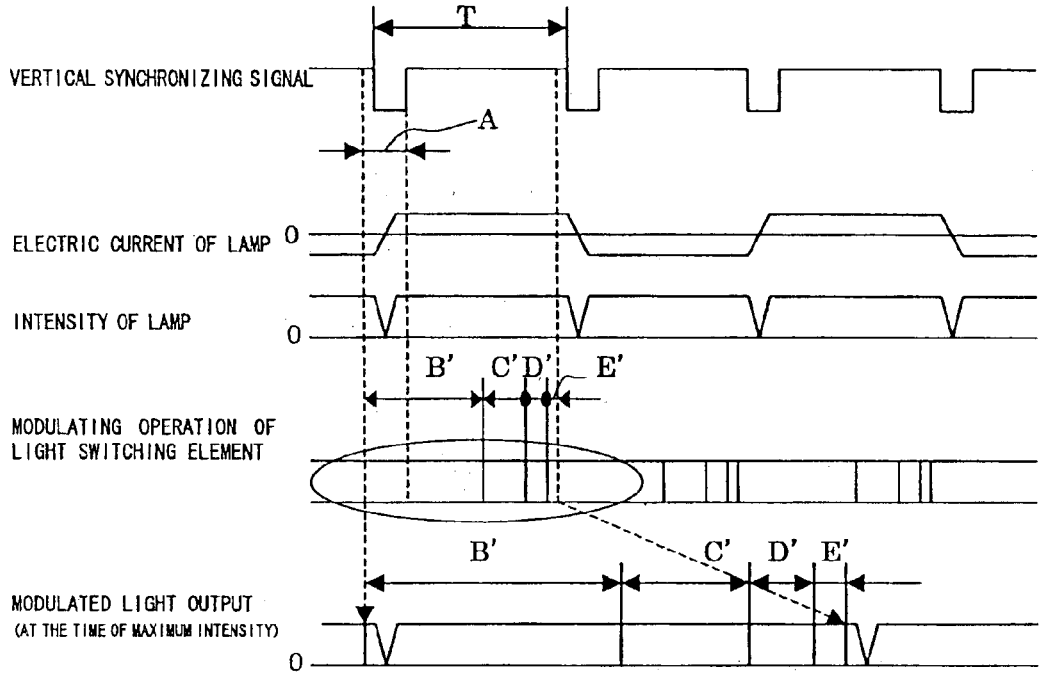
FIG. 8 is a timing chart explaining an operation of the intensity modulator according to the second embodiment.

The light switching element driving circuit 5, as shown in FIG. 8, sets the unit periods B', C', D' and E' in the control operation. Particularly, the control operation of the light switching element driving circuit 5 is characterized by the setting of the unit period B'.

The light switching element driving circuit 5 sets the unit period B', C', D' and E' in the following manner. A total period (B'+C'+D'+E') obtained by summing up the unit period B', C', D' and E' is set so as to be equal to or slightly shorter than the time length of the period T defined by the cycle of the vertical synchronizing signal. Further, the unit period D' is set into a time length which is twice as long as the unit period E'. The unit period C' is set to a time length which is twice as long as the unit period D'. This constitution is the same as that in the first embodiment. In the second embodiment, the unit period B' into which the output fluctuation point A is inserted is set as follows.

The unit period B' is set to a time length which is twice as long as the unit period C', namely, a time length obtained by adding/subtracting adjustment for correcting fluctuation of the intensity of the AC lamp 2. The time length for correcting intensity fluctuation is set as follows.

At the output fluctuation point A, the ON time of the light switching element 3 is not properly proportional to the light output. For this reason, at the unit period (for example, unit period B') into which the output fluctuation point A is inserted, error occurs in an occurrence rate of the intensity covered at this unit period. In the basic control method of the present invention, the output fluctuation point A is inserted into the unit period at which the error ratio is as small as possible, so that the viewer hardly visually recognizes the flicker due to the intensity error.

In the second embodiment, in addition to the basic control method of the present invention, the time length of the unit period into which the output fluctuation point A is inserted is finely adjusted so that the intensity error is made to be as small as possible. An adjusting quantity of the time length is set to a value for correcting a predicted occurrence rate of the intensity error. As a result, the intensity error becomes as small as possible, and thus the viewer more hardly visually recognizes the flicker due to the intensity error.

A predicted value of the occurrence of the intensity error, however does not always match with the actual occurrence rate of the intensity error accurately. For this reason, even in the control method of the second embodiment, slight intensity error occurs in the unit period (unit period B' or the like) into which the output fluctuation point A is inserted. In the second embodiment, the basic control method of the present invention for inserting the output fluctuation point A into the unit period where the error ratio becomes small and the error finely adjusting method of the second embodiment are carried out simultaneously, so that the viewer hardly visually recognizes the flicker due to the intensity error.

(Third Embodiment)

Figure 9:
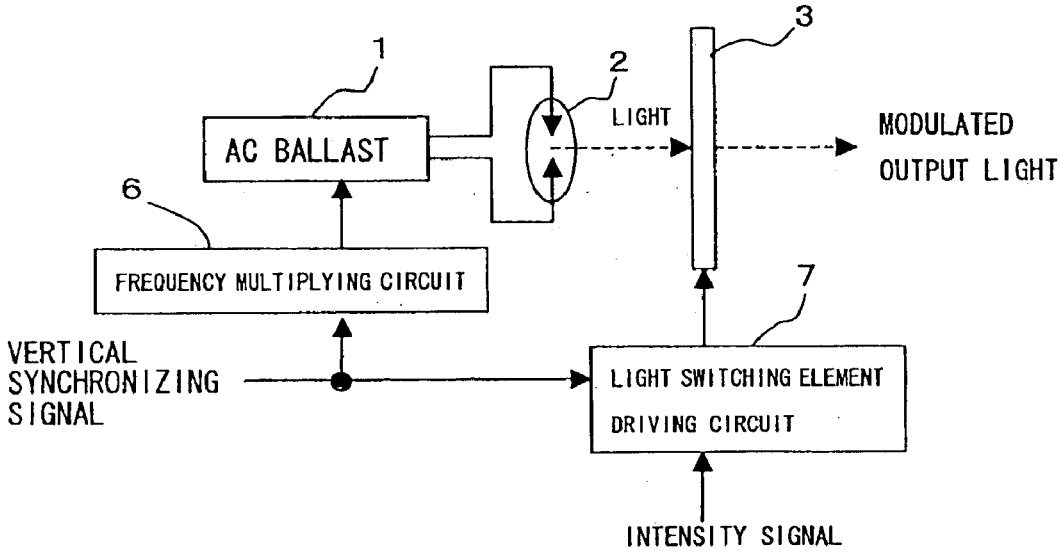
FIG. 9 is a diagram illustrating a constitution of the intensity modulator according to a third embodiment of the present invention.

FIG. 9 illustrates a constitution of the intensity modulator according to the third embodiment. The intensity modulator of the third embodiment basically has the constitution similar to the first embodiment. For this reason, in FIG. 9, like parts are designated by like reference numerals of FIG. 1. A first characteristic of the third embodiment is a frequency converting circuit 6 for converting a frequency of the vertical synchronizing signal. Further, a second characteristic of the third embodiment is a control operation which is performed by the light switching element driving circuit 7 as the frequency converting circuit 6 converts a frequency of the vertical synchronizing signal. The following assumes and explains the case where the control, for inserting the output fluctuation point A into the unit period B as the most significant bit period is made similarly to the first embodiment. In the third embodiment, however, the same operation is performed even in the case where the control, for inserting the output fluctuation point A into another unit period (unit period C or the like), is made.

Figure 10:
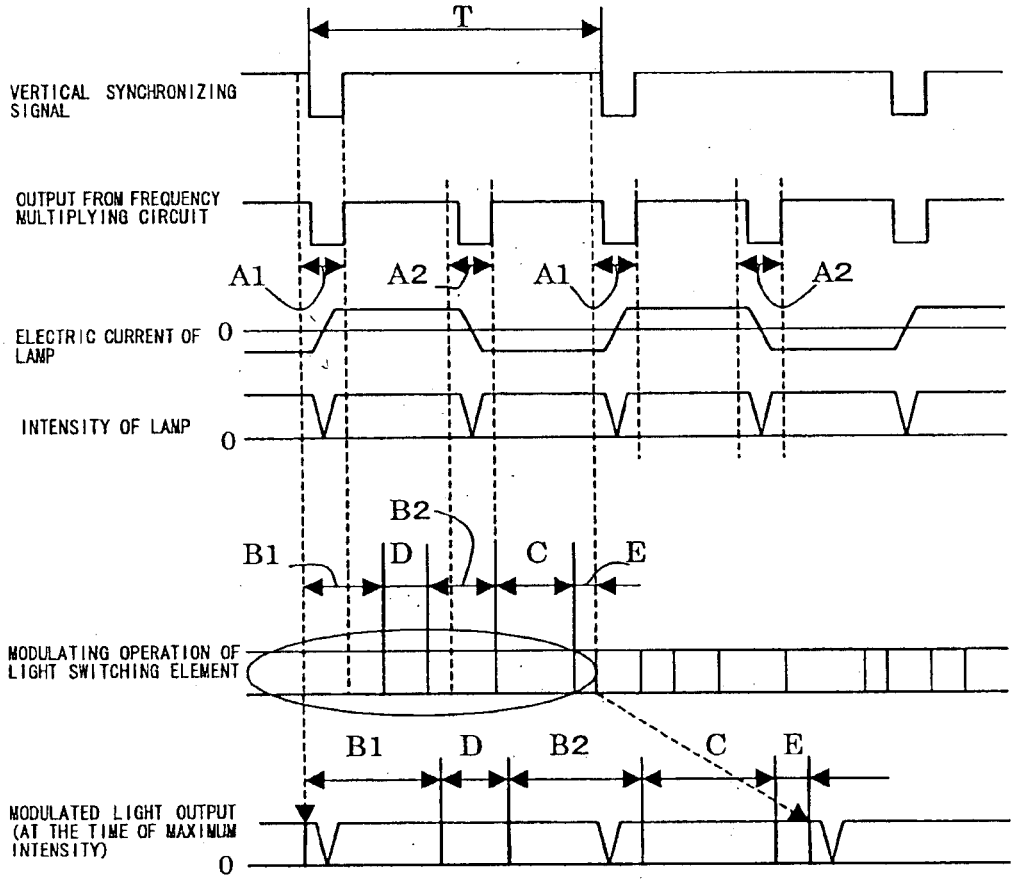
FIG. 10 is a diagram for explaining an operation of the intensity modulator according to the third embodiment.

FIG. 10 is an explanatory diagram illustrating the control operation of the intensity modulator according to the third embodiment. The frequency converting circuit 6 converts a frequency of a vertical synchronizing signal to be input. The frequency converting process is executed with a value obtained by dividing the frequency of the vertical synchronizing signal being used by an integer as a conversion ratio. Hereinafter, the vertical synchronizing signal which undergoes the frequency converting process is referred to as a vertical synchronizing signal (conversion). The vertical synchronizing signal (conversion) is input into the AC ballast 1 and the light switching element driving circuit 7. The AC ballast 1 synchronizes the process for converting the polarity of the electric current to be supplied to the AC lamp 2 with the vertical synchronizing signal (conversion). FIG. 10 illustrates an example in the case where the conversion ratio is two. In this case, the two output fluctuation points A are arranged on each period of the vertical synchronizing signal. The two output fluctuation points A arranged on each period of the vertical synchronizing signal are represented by A1 and A2 in order of time. The time length of the output fluctuation points A1 and A2 does not change as compared with the aforementioned output fluctuation point A. In the first embodiment where the frequency of the vertical synchronizing signal is not converted, the one output fluctuation point A is arranged on each period of the vertical synchronizing signal.

The light switching element circuit 7 prestores the conversion ratio of the vertical synchronizing signal (conversion) and executes a next process according to the stored conversion ratio. The light switching element driving circuit 7 first divides the unit period (in the third embodiment, unit period B) into which the output fluctuation points A1 and A2 are inserted by the conversion ratio (in the third embodiment, 2). In this case, it is preferable that equal division is carried out in order to facilitate the control, but the intensity error can be corrected in the third embodiment even if the equal division is not carried out. Hereinafter, the unit period to be divided is represented as a divided unit period. In the third embodiment where the unit period B is divided by the conversion ratio (2), hereinafter, the divided unit periods are represented by B1 and B2.

The light switching element driving circuit 7 makes the arrangement control of the unit period so that the unit periods B1, B2, C, D and E can be inserted into the periods T. At this time, the arrangement of the unit periods B1, B2, C, D and E is set so that the output fluctuation points Al and A2 are inserted into the divided unit periods B1 and B2, respectively.

A time length obtained by adding the time length of the divided unit period B1 and the time length of the unit period B2 becomes equal to that of the unit period B explained in the first embodiment. For this reason, similarly to the first embodiment, the viewer hardly visually recognizes the flicker due to the intensity error which occurs in the modulated output light output from the light modulator of the third embodiment. Further, a cycle (cycle where the output fluctuation points A1 and A2 are generated) where the intensity error occurs is shorter than the cycle of the vertical synchronizing signal by the frequency converting process. People have eyesight characteristics such that as the occurrence cycle of the intensity error becomes shorter, people hardly visually recognize flicker due to the intensity error. For this reason, in the control method of the third embodiment, the viewer hardly visually recognizes. the flicker due to the intensity error as the occurrence cycle of the intensity error becomes shorter due to the frequency converting process.

The frequency converting process in the third embodiment is executed with the value which is obtained by dividing the frequency of the vertical synchronizing signal being used by an integer as the conversion ratio as mentioned above. This is generally called a multiplying process. In the third embodiment, the frequency converting process further includes the case where the vertical synchronizing signal (conversion) which undergoes the frequency converting process further undergoes a next fine adjusting process. The fine adjusting process is for advancing and treating one or a plurality of synchronizing points defined by the vertical synchronizing signal (conversion) on the time axis by a predetermined time. This process can be executed by, for example, adjusting time count setting of a counter to be used for the frequency converting process. In the third embodiment, when the frequency converting process and the fine adjusting process are executed, the third embodiment can be carried out and the similar effect is displayed.

In the third embodiment, similarly to the second embodiment, it is preferable that the total time length of the divided unit periods (in the third example, B1 and B2) into which the output fluctuation points A1 and A2 are inserted is finely adjusted according to the occurring intensity error, thereby further reducing the occurrence quantity of the intensity error.

Further in the third embodiment, the frequency converting circuit 6 changes the conversion ratio so as to adjust the frequency at which the polarity of the AC lamp 2 is switched. As a result, the frequency suitable for driving the AC lamp 2 can be set.

(Fourth Embodiment)

Figure 11:
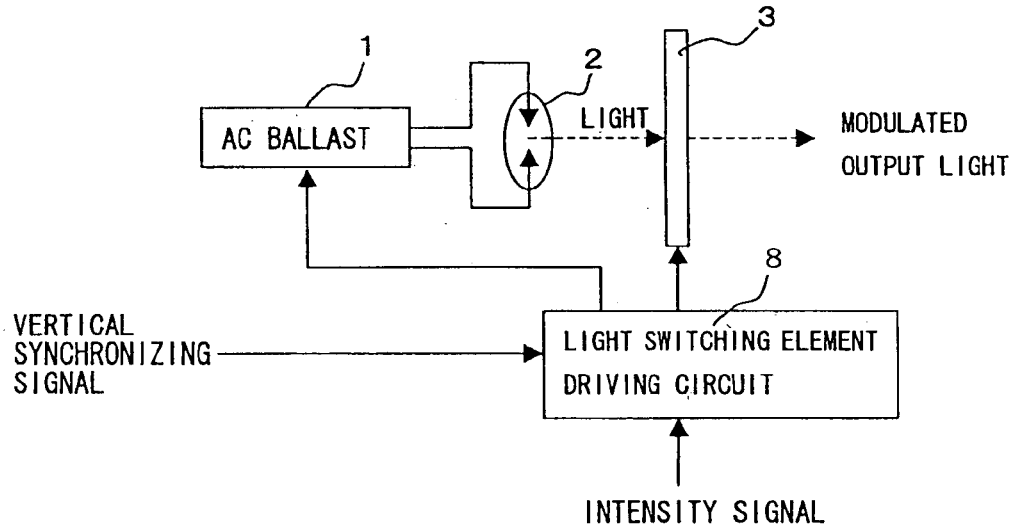
FIG. 11 is a diagram illustrating a constitution of the intensity modulator according to a fourth embodiment of the present invention.

FIG. 11 illustrates the constitution of the intensity modulator according to the fourth embodiment. The intensity modulator of the fourth embodiment basically has the constitution similar to the first embodiment. For this reason, in FIG. 11, like parts are designated by like reference numerals of FIG. 1. The fourth embodiment is characterized by the control operation which is performed by the light switching element driving circuit 8. The following assumes and explains the case where the control, for inserting the output fluctuation point A into the unit period B as the most significant bit period, is made similarly to the first embodiment. In the fourth embodiment, however, the operation is performed similarly even in the case where the control for inserting the output fluctuation point A into another unit period (unit period C or the like) is made.

In the first and second embodiments, the output fluctuation point A is arranged in synchronization with the synchronizing point of the vertical synchronizing signal (timing of a trailing edge). In the third embodiment, the vertical synchronizing signal (multiply) which is multiplied by the vertical synchronizing signal is generated, and the output fluctuation point A is arranged in synchronization with the vertical synchronizing signal (multiply), but basically the output fluctuation point A is arranged in synchronization with the synchronizing point of the vertical synchronizing signal. In the fourth embodiment, however, the light switching element driving circuit 8 made following control.

Figure 12:
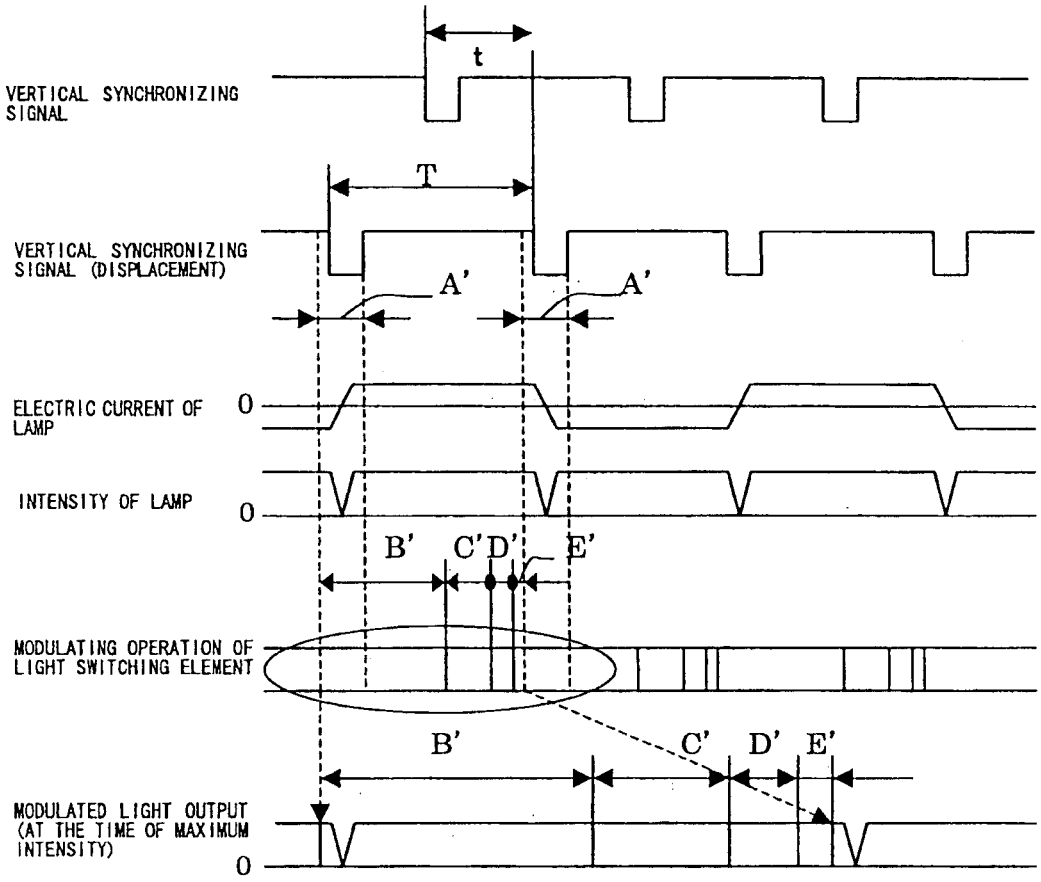
FIG. 12 is a diagram for explaining an operation of the intensity modulator according to the fourth embodiment.

The light switching element driving circuit 8 generates a vertical synchronizing signal (displacement) based on the vertical synchronizing signal. As shown in FIG. 12, the vertical synchronizing signal (displacement) has the same cycle as that of the vertical synchronizing signal, but the cycle timing displaces from the vertical synchronizing signal only by time quantity "t". The light switching element driving circuit 8 outputs the generated vertical synchronizing signal (displacement) to the AC ballast 1. The AC ballast 1 drives the AC lamp 2 based on the vertical synchronizing signal (displacement). The output fluctuation point A which matches with the cycle timing of the vertical synchronizing signal (displacement) is present in the electric current which is used when the AC ballast 1 drives the AC lamp 2. The output fluctuation point A' fluctuates in the intensity of the output light from the AC lamp 2.

The light switching element driving circuit 8 controls the light switching element 3 so that the output fluctuation point A' is positioned on the unit period B (the most significant bit period).

When the above-mentioned control is made, thereby, in the fourth embodiment, displaying the function similar to the other embodiments. In the fourth embodiment, the present invention can be carried out even in the constitution where the output fluctuation point A' is arranged on arbitrary time timing.

(Fifth Embodiment)

Figure 13:
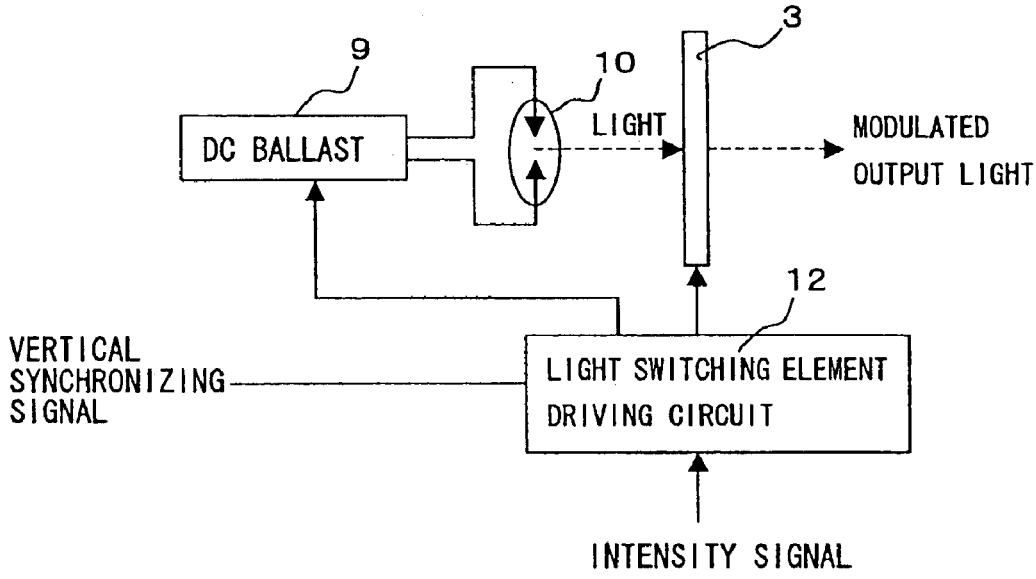
FIG. 13 is a diagram illustrating a constitution of the intensity modulator according to a fifth embodiment of the present invention.

FIG. 13 illustrates a constitution of the intensity modulator according to the fifth embodiment. The intensity modulator of the fifth embodiment basically has the constitution similar to the first embodiment. The intensity modulator of the fifth embodiment is driven by a DC current and has a DC lamp 10, a DC ballast 9 for driving the DC lamp 10, the light switching element 3, and the light switching element driving circuit 12. The following explanation assumes the case where the control, for inserting the output fluctuation point A into the unit period B as the most significant bit period, is made similarly to the first embodiment. The present invention, however, is carried out similarly even in the case where the control for inserting the output fluctuation point A into another unit period (unit period C or the like) is made.

Figure 14:
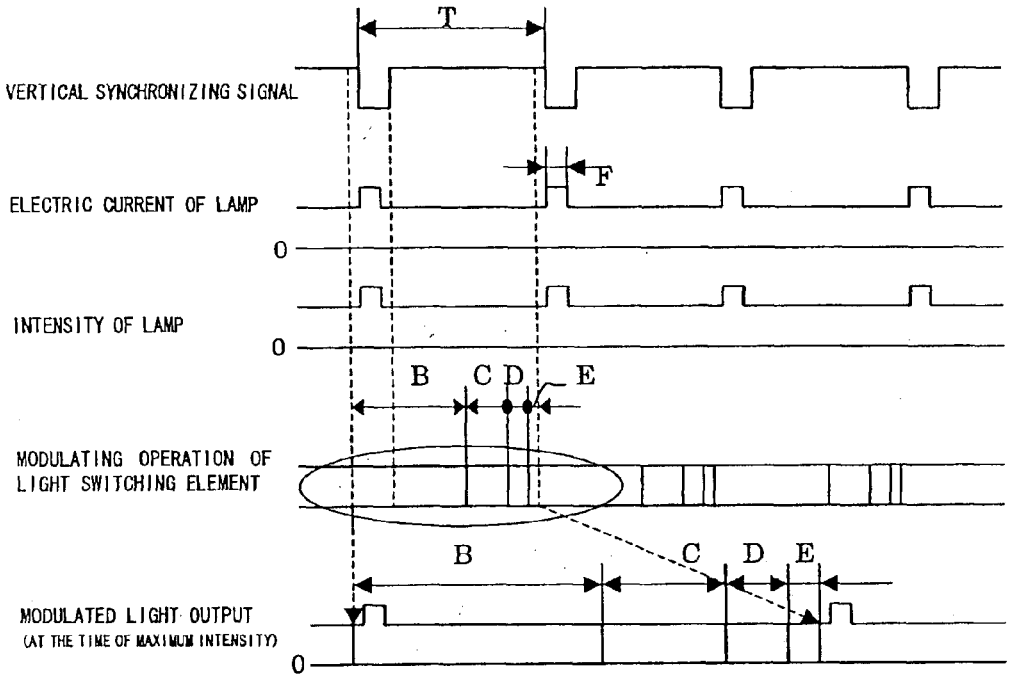
FIG. 14 is a diagram for explaining an operation of the intensity modulator according to the fifth embodiment.

The DC lamp 10 is composed of a high-power DC type ultra-high pressure mercury lamp. When the DC lamp 10 having such a constitution is driven, the output fluctuation point A is not generated. As shown in FIG. 14, however, control, for providing a period at which a driving current of the DC lamp 10 is made to be eruptively high to the driving current, may be made in order to prevent flicker. Hereinafter, the period at which the electric current is made to be high is called a high current supplying period F. The high current supplying period F is normal set at the same cycle as the cycle of the synchronizing period T. Further, the synchronizing timing of the respective high current supplying periods F is set so as to match with the synchronizing timing (timing of trailing edge) of the synchronizing period T.

When such driving control is made, similarly to the intensity error which occurs in the output fluctuation point A in the AC lamp, intensity error occurs in the modulated output light at the high current supplying period F. In this case, positive intensity error occurs, and this is different from negative intensity error which occurs in the constitution using the AC lamp.

The light switching element driving circuit 12, as shown in FIG. 14, controls the light switching element 3 so that the high current supplying period F is positioned in the most significant bit period. In the constitution of the fifth embodiment where the output fluctuation point A synchronizes with the cycle timing of the vertical synchronizing signal, the light switching element driving circuit 12 controls the light switching element 3 so that the most significant bit period is superposed on the high current supplying period F.

With such setting, similarly to the other embodiments, the flicker due to the occurring intensity error is hardly visually recognized by the viewer.

Figure 15:
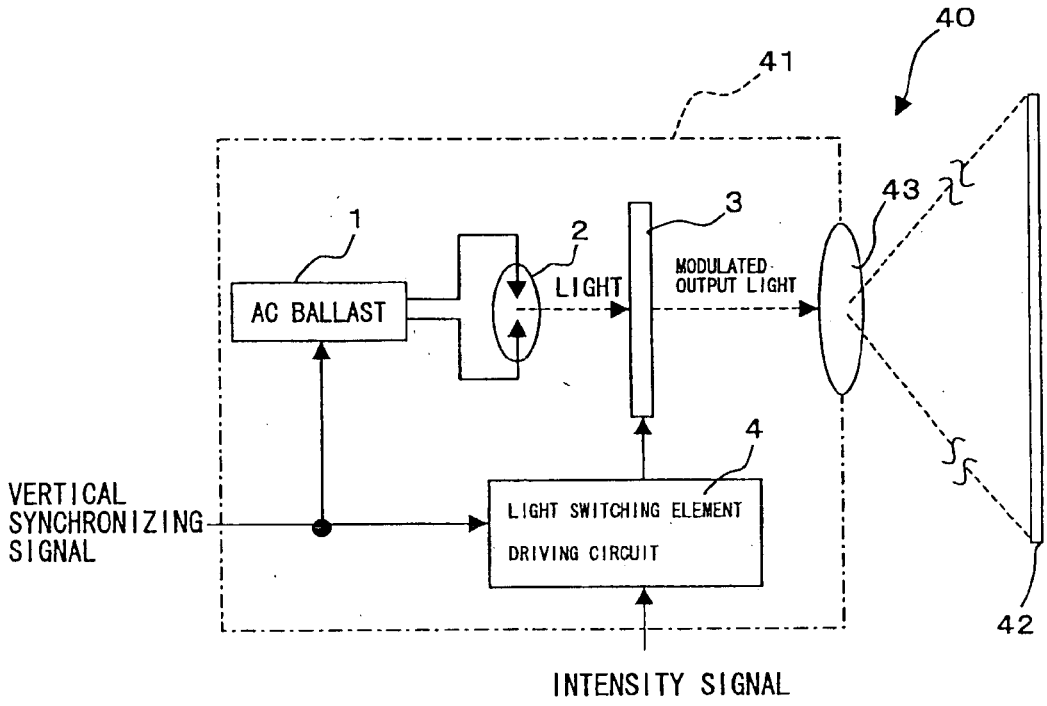
FIG. 15 is a diagram illustrating a constitution of a projector into which the intensity modulator of the present invention is incorporated.
Figure 16:
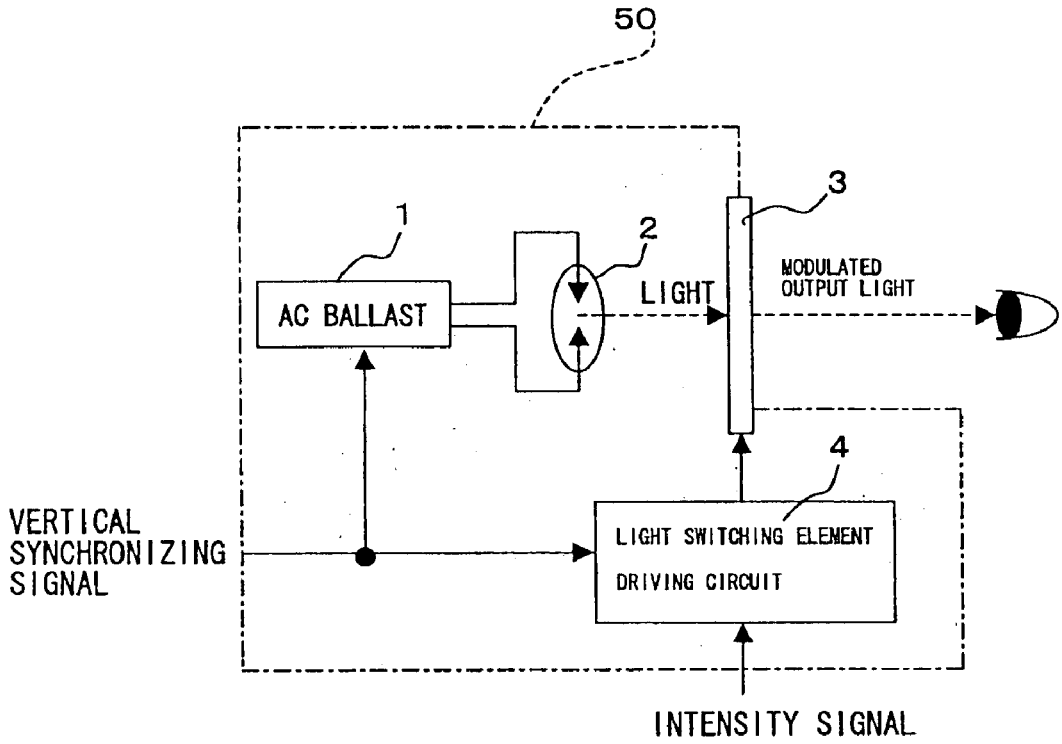
FIG. 16 is a diagram illustrating a constitution of a direct-view image display device into which the intensity modulator of the present invention is incorporated.

In the above-mentioned embodiments, the present invention is carried out in the intensity modulator. The present invention also can be carried out in image display devices shown in FIGS. 15 and 16. FIG. 15 illustrates a projector 40 into which the intensity modulator of the foregoing embodiments is incorporated. FIG. 16 illustrates a direct-view image display device into which the intensity modulator of the foregoing embodiments is incorporated.

In FIG. 15, reference numeral 41 denotes an intensity modulator which can be constituted by any one of the embodiments, and 42 denotes a screen, and 43 denotes a projection lens for projecting modulated output light onto the screen 42. In FIG. 16, reference numeral 50 denotes the direct-view image display device. The direct-view image display device is composed of the intensity modulator.

In the constitutions of FIGS. 15 and 16, the intensity modulator can be constituted by any one of the foregoing embodiments. In FIGS. 15 and 16, the intensity modulator of the first embodiment is incorporated as one example of the intensity modulator.

The present invention is explained in detail with reference to the most preferable embodiments, but the combination and arrangement of the parts in the preferable embodiments can be modified variously without departing from the spirit and scope of the invention to be claimed below.

What is claimed is:

1. An intensity modulator, comprising:

a light source driving circuit for periodically generating an output fluctuation point on a time axis;

a light source which is driven by the light source driving circuit so as to output light;

a light passage controller for controlling passage of the light; and a modulation controller for setting predetermined synchronizing periods and a plurality of unit periods with different time lengths in each of the synchronizing periods, controlling passage of the light using the light passage controller at each of the unit periods, and controlling intensity of the light so as to modulate pulse width at each of the synchronizing periods, wherein the modulation controller selects the unit period, where the intensity error which occurs with the output fluctuation point being inserted is predicted not to be visually recognized with human's eyesight characteristics, from the unit periods, and controls arrangement of the unit periods so that the output fluctuation point is inserted into the selected unit period.

2. The intensity modulator according to claim 1, wherein an occurrence cycle of the output fluctuation point synchronizes with the synchronizing period.

3. The intensity modulator according to claim 1, wherein the modulation controller selects the unit period where the intensity error is predicted so as not to be visually recognized from the unit periods for a level of intensity generated by making the passage control of the light using the light passage controller based on a ratio (intensity error/intensity level) of the intensity error occurring by inserting the output fluctuation point into the unit periods.

4. The intensity modulator according to claim 1, wherein the modulation controller controls the arrangement of the unit periods so that the output fluctuation point is inserted into a unit period with the longest time length.

5. The intensity modulator according to claim 1, wherein the modulation controller adjusts the time length of the unit period, into which the output fluctuation point is inserted, so as to have a length with which the intensity error can be corrected.

6. The intensity modulator according to claim 1, wherein the light source driving circuit comprises an AC power source for switching polarity of the AC power source alternatively at each synchronizing period, and the output fluctuation point is generated when the polarity of the AC power source is switched.

7. The intensity modulator according to claim 1, wherein the light source driving circuit comprises an AC power source for switching polarity of the AC power source alternatively based on a frequency which is obtained by converting a frequency defined by the synchronizing period.

8. The intensity modulator according to claim 1, wherein the light source driving circuit comprises a DC power source for generating an electric current at each synchronizing period.

9. An image display device, comprising:

a light source driving circuit for periodically generating an output fluctuation point on a time axis;

a light source which is driven by the light source driving circuit so as to output light;

a light passage controller for controlling passage of the light; and a modulation controller for setting predetermined synchronizing periods and a plurality of unit periods with different time lengths at each of the synchronizing periods, controlling passage of the light using the light passage controller at each of the unit periods, and controlling intensity of the light so as to modulate a pulse width at each of the synchronizing periods, wherein the modulation controller selects a unit period, where the intensity error which occurs with the output fluctuation point being inserted is predicted not to be visually recognized with human's eyesight characteristics, from the unit periods, and controls arrangement of the unit periods so that the output fluctuation point is inserted into the selected unit period.

* * * * *